US010301691B2

(12) United States Patent
Feyisa et al.

(10) Patent No.: US 10,301,691 B2
(45) Date of Patent: May 28, 2019

(54) METHOD FOR TREATING AN ANIMAL SUBSTRATE

(71) Applicant: Xeros LTD, Rotherham, South Yorkshire (GB)

(72) Inventors: Addis Duki Feyisa, Rotherham (GB); John Edward Steele, Rotherham (GB)

(73) Assignee: Xeros Limited, Rotherham (GB)

( * ) Notice: Subject to any disclaimer, the term of this patent is extended or adjusted under 35 U.S.C. 154(b) by 93 days.

(21) Appl. No.: 15/513,309

(22) PCT Filed: Oct. 1, 2015

(86) PCT No.: PCT/GB2015/052879
§ 371 (c)(1),
(2) Date: Mar. 22, 2017

(87) PCT Pub. No.: WO2016/051189
PCT Pub. Date: Apr. 7, 2016

(65) Prior Publication Data

US 2017/0240980 A1 Aug. 24, 2017

(30) Foreign Application Priority Data

Oct. 3, 2014 (GB) ..... 1417487.4

(51) Int. Cl.

| | |
|---|---|
| ***C14C 15/00*** | (2006.01) |
| ***C14C 3/30*** | (2006.01) |
| ***C14C 3/08*** | (2006.01) |
| ***C14C 3/16*** | (2006.01) |
| ***C14C 3/28*** | (2006.01) |

(Continued)

(52) U.S. Cl.
CPC ..... *C14C 3/30* (2013.01); *C14B 1/00* (2013.01); *C14C 3/08* (2013.01); *C14C 3/10* (2013.01); *C14C 3/16* (2013.01); *C14C 3/22* (2013.01); *C14C 3/28* (2013.01); *D06P 3/32* (2013.01)

(58) Field of Classification Search
CPC .... C14C 3/08; C14C 3/28; C14C 3/22; C14C 3/10; D06P 3/32; C14B 1/00
See application file for complete search history.

(56) References Cited

U.S. PATENT DOCUMENTS

| | | | |
|---|---|---|---|
| 3,591,326 | A | 7/1971 | Johnels |
| 3,806,412 | A | 4/1974 | Gagne et al. |

(Continued)

FOREIGN PATENT DOCUMENTS

| | | | |
|---|---|---|---|
| AU | 702280 | B2 | 2/1999 |
| CA | 868968 | A | 4/1971 |

(Continued)

OTHER PUBLICATIONS

U.S. Appl. No. 15/414,314, He et al.

(Continued)

*Primary Examiner* — Eisa B Elhilo
(74) *Attorney, Agent, or Firm* — Clark & Elbing LLP

(57) ABSTRACT

A method for tanning an animal substrate comprising the steps: i) agitating the animal substrate with a chromium-free tanning agent; and ii) agitating the animal substrate with a tanning agent having an oxazolidine group; wherein at least some of the agitation is performed in the presence of a solid particulate material having an average particle size of from 1 to 500 mm.

37 Claims, 1 Drawing Sheet

(a)

(51) Int. Cl.

| | |
|---|---|
| ***C14B 1/00*** | (2006.01) |
| ***C14C 3/10*** | (2006.01) |
| ***C14C 3/22*** | (2006.01) |
| ***D06P 3/32*** | (2006.01) |

(56) References Cited

U.S. PATENT DOCUMENTS

| | | | |
|---|---|---|---|
| 4,221,564 | A | 9/1980 | Plapper et al. |
| 4,272,242 | A | 6/1981 | Plapper et al. |
| 5,709,714 | A | 1/1998 | Natoli et al. |
| 6,237,373 | B1 | 5/2001 | Harris et al. |
| 8,118,942 | B2 | 2/2012 | Featherson et al. |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 2004/0045092 | A1 | 3/2004 | Cassingham |
| 2005/0229354 | A1 | 10/2005 | Dinteman et al. |
| 2006/0101584 | A1 | 5/2006 | Hueffer et al. |
| 2008/0111269 | A1 | 5/2008 | Politi et al. |
| 2008/0251356 | A1 | 10/2008 | Bratusa et al. |
| 2009/0205142 | A1 | 8/2009 | Vorlander et al. |
| 2011/0296628 | A1 | 12/2011 | Jenkins et al. |
| 2012/0048299 | A1 | 3/2012 | Jenkins et al. |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2013/0340487 | A1 | 12/2013 | Yin et al. |
| 2014/0096328 | A1 | 4/2014 | He et al. |
| 2014/0123399 | A1* | 5/2014 | Reiners ..... C14C 3/08 8/94.33 |
| 2014/0201929 | A1 | 7/2014 | He et al. |
| 2014/0230160 | A1 | 8/2014 | He et al. |
| 2014/0237731 | A1 | 8/2014 | He et al. |
| 2014/0283314 | A1 | 9/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |
| 2017/0159222 | A1 | 6/2017 | Jenkins et al. |
| 2017/0240980 | A1 | 8/2017 | Feyisa et al. |
| 2017/0240981 | A1 | 8/2017 | Scott |
| 2017/0240982 | A1 | 8/2017 | Sadeghi |
| 2017/0241061 | A1 | 8/2017 | Wells et al. |
| 2017/0247771 | A1 | 8/2017 | Scott |
| 2017/0267949 | A1 | 9/2017 | Bird et al. |
| 2018/0057777 | A1 | 3/2018 | Waddon et al. |
| 2018/0127914 | A1 | 5/2018 | Wells et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |

FOREIGN PATENT DOCUMENTS

| | | | |
|---|---|---|---|
| CN | 2310074 | Y | 3/1999 |
| CN | 101360837 | A | 2/2009 |
| CN | 102061589 | A | 5/2011 |
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202298235 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 202989172 | U | 6/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 102061588 | B | 2/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |

(56) References Cited

FOREIGN PATENT DOCUMENTS

| | | | | | |
|---|---|---|---|---|---|
| CN | 105421000 | A | | 3/2016 | |
| CN | 105442267 | A | | 3/2016 | |
| CN | 205329373 | U | | 6/2016 | |
| CN | 205329374 | U | | 6/2016 | |
| CN | 205329380 | U | | 6/2016 | |
| CN | 205329384 | U | | 6/2016 | |
| EP | 0439108 | A1 | | 7/1991 | |
| EP | 0306236 | B1 | | 4/1993 | |
| GB | 498506 | A | | 1/1939 | |
| GB | 874232 | A | | 8/1961 | |
| GB | 1186368 | A | | 4/1970 | |
| GB | 1332999 | A | | 10/1973 | |
| GB | 1481 508 | A | * | 8/1977 | ..... C14C 3/08 |
| GB | 1481508 | A | | 8/1977 | |
| GB | 2287953 | A | | 10/1995 | |
| JP | H01318100 | A | | 12/1989 | |
| JP | H09-512573 | A | | 12/1997 | |
| JP | 2003017457 | A | | 1/2003 | |
| JP | 2009148699 | A | | 7/2009 | |
| RO | 98565 | B1 | | 3/1990 | |
| RU | 2206619 | C1 | | 6/2003 | |
| SU | 720020 | A1 | | 3/1980 | |
| WO | WO-88/10317 | A1 | | 12/1988 | |
| WO | WO-02/12569 | A1 | | 2/2002 | |
| WO | WO-2004/061136 | A1 | | 7/2004 | |
| WO | WO-2007/128962 | A1 | | 11/2007 | |
| WO | WO-2009/153345 | A2 | | 12/2009 | |
| WO | WO-2010/094959 | A1 | | 8/2010 | |
| WO | WO-2011/064581 | A1 | | 6/2011 | |
| WO | WO-2011/098815 | A1 | | 8/2011 | |
| WO | WO-2011/128676 | A1 | | 10/2011 | |
| WO | WO-2012/056252 | A2 | | 5/2012 | |
| WO | WO-2012/095677 | A2 | | 7/2012 | |
| WO | WO-2014/080192 | A1 | | 5/2014 | |
| WO | WO-2014/147391 | A1 | | 9/2014 | |

OTHER PUBLICATIONS

U.S. Appl. No. 15/510,569, Xeros Ltd.
U.S. Appl. No. 15/510,576, Xeros Ltd.
U.S. Appl. No. 15/513,014, Xeros Ltd.
U.S. Appl. No. 15/518,047, Xeros Ltd.
Afsar et al., "An investigation about the effect of oxazolidine on modified valonia extract tanning," African Journal of Biotechnology. 7(20):3737-42 (2008).
International Search Report and Written Opinion for International Application No. PCT/GB2015/052879, dated Jan. 27, 2016 (11 pages).
Jing et al., "A novel oxazolidine tanning agent and its use in vegetable combination tanning," The Journal of the Society of Leather Technologists and Chemists 95(4):165-70 (2011).
Musa et al., "Studies on combination tanning based on henna and oxazolidine," The Journal of the American Leather Chemist's Association 104(10):335-43 (2009).
Search Report for United Kingdom Application No. GB1417487.4, dated Apr. 2, 2015 (6 pages).
U.S. Appl. No. 15/532,137, Xeros Ltd.
International Preliminary Report on Patentability for International Application No. PCT/GB2015/052879 dated Jan. 16, 2017 (14 pages).
U.S. Appl. No. 16/093,398, Xeros Ltd.
U.S. Appl. No. 16/093,433, Xeros Ltd.
U.S. Appl. No. 16/093,449, Xeros Ltd.
Hudson et al, "Leather coloration," Rev. Prog. Coloration. 30: 67-75 (2000).

* cited by examiner

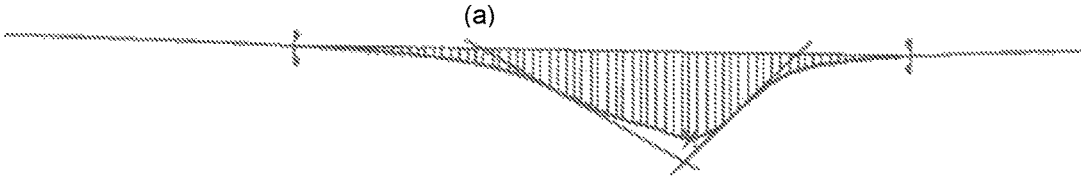
(a)

METHOD FOR TREATING AN ANIMAL SUBSTRATE

This invention relates to an improved method for tanning an animal substrate, to animal substrates obtained by said method and to articles comprising said tanned substrates.

BACKGROUND

At present most of the output from the leather industry is derived from the tanning of animal substrates (e.g. hides) using chromium III containing tanning agents to form an intermediate leather substrate. This intermediate tanned substrate is also known as 'wet blue'. Wet blue is typically re-tanned, dyed and finished. Chromium III is a particularly effective tanning agent and provides leathers which perform exceptionally well, however there is an increasing level of concern regarding the toxicology and environmental safety of tanning agents containing chromium III compounds.

Attempts have been made to provide tanning agents and processes which are "free-of-chromium" (FOC) and one such FOC option is referred to as "wet white". Generally, "wet white" is a material obtained by tanning pickled hides/skins with pre-tanning agents such as as aldehydes (e.g. glutaraldehyde), aluminium (III) based tanning products or synthetic tanning agents (syntans).

Unfortunately, in many industrial applications, leathers derived from wet-white processes do not perform as well as chromium III tanned (wet blue) leathers. In particular, the hydrothermal stability, of wet white leather is substantially lower than that for chromium III tanned leather. Generally, for wet white leather substrates, the shrinkage temperatures of the final leathers do not exceed 90° C., and are typically in the region 70-80° C. Thus wet-white based leathers are not commonly used for applications where hydrothermal stability is needed e.g. in steam forming as is often used in the manufacturing of shoes.

The performance requirements of automotive leathers can be especially stringent. Automotive leathers can be required to have greater hydrothermal stability and resistance to photochemical and/or thermal ageing in many demanding environments. Such requirements are likely to become more important to the high-performance automotive leather in the future.

It has also been observed by the present inventors that known tanning processes tend not to provide conditions which facilitate suitably deep penetration of the tanning agents into the substrate, especially when small amounts of fluid (e.g. water) are employed.

In view of the foregoing there is a need for a method of tanning an animal substrate using an efficient, environmentally kind process, utilizing a chromium-free tanning agent which provides a resulting substrate with one or more of the following desirable properties:

1. High hydrothermal stability relative to those normally obtainable with wet white processes;
2. High photochemical/thermal resistance relative to those normally obtainable with wet white processes;
3. High levels of incorporation of the tanning agent;
4. Deep penetration of the tanning agent into the substrate.

It is also an object of the present invention to provide a method which achieves sufficiently tanned animal substrates more rapidly.

The present invention has as its objectives the provision of a tanning process, resulting tanned animal substrates and final articles comprising the tanned animal substrates which addresses, at least in part, one or more of these needs.

BRIEF SUMMARY OF THE DISCLOSURE

According to a first aspect of the present invention there is provided a method for tanning an animal substrate comprising the steps:

i) agitating the animal substrate with a chromium-free tanning agent; and ii) agitating the animal substrate with a tanning agent having an oxazolidine group;

wherein at least some of the agitation is performed in the presence of a solid particulate material, and wherein the solid particulate material has an average particle size of from 1 to 500 mm.

Steps i) and ii) may be performed separately, simultaneously or the steps i) and ii) overlap in time.

Preferably, the steps i) and ii) are performed in the order step i) followed by step ii).

At least some of the agitation in both steps i) and ii) is suitably performed in the presence of the particulate solid material.

Preferably, the solid particulate material has an average particle size of from 1 to 100 mm, more typically the solid particulate material has an average particle size of from 1 to 50 mm.

The solid particulate material preferably has a density of from 1.0 to 5.0 g/cm$^3$.

Typically, the chromium-free tanning agent is one or more tanning agents selected from vegetable tanning agents, synthetic tanning agents and aldehydes, more typically a vegetable tanning agent. The chromium-free tanning agent may also be or comprise one or more mineral tanning agents other than those containing chromium including those containing aluminium, titanium, zirconium or iron salts or complexes or combinations thereof.

Typically, the vegetable tanning agent is a catechol-type tanning agent, more typically the vegetable tanning agent is or comprises a catechol.

Typically, the vegetable tanning agent is or comprises an extract selected from mimosa, birch, hemlock, quebracho, alder, fir and oak or a chemical derivative thereof, more typically the vegetable tanning agent is or comprises an extract from mimosa or a chemical derivative thereof.

The chromium-free tanning agent may be sulphited although preferably the chromium-free tanning agent is not sulphited. This is especially so in the case of vegetable tanning agents.

The chromium-free tanning agent(s) is/are preferably present in a total amount of from 0.1 to 100 wt % relative to the weight of animal substrate.

Typically the tanning agent having an oxazolidine group has one or more oxazolidine groups of the chemical Formula (1) or (2):

Formula (1)

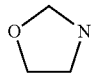

Formula (2)

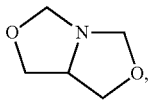

Preferably, the tanning agent having an oxazolidine group is of the Formula (3), (4) or (5):

Formula (3)

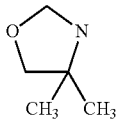

Formula (4)

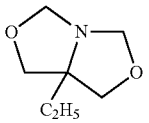

Formula (5)

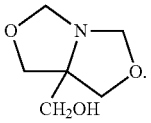

The tanning agent having an oxazolidine group is preferably present in an amount of from 0.1 to 100% by weight relative to the weight of animal substrate.

Typically, step i) is performed at a pH of no more than 5, more typically at a pH of no more than 4.5.

Typically, step ii) is performed at a pH of at least 5, more typically a pH of at least 6.

Optionally, the method according to the first aspect of the present invention additionally comprises a tanning step A) of agitating the animal substrate with an aldehyde-containing tanning agent, which typically is or comprises glutaraldehyde.

The tanning step A) typically precedes step i).

Preferably, the solid particulate material is or comprises a polymeric or non-polymeric material, more typically is or comprises a polymeric material. Suitable polymeric materials can be selected from polyalkylenes, polyesters, polyamides and polyurethanes including mixtures and copolymers thereof.

Preferably, the weight ratio of animal substrate:solid particulate material is from 5:1 to 1:5.

Preferably, at least some of the agitation steps are performed for at least some of the time in the presence of water.

Typically, when water is present the weight ratio of animal substrate to water is from 1:5 to 100:1.

Preferably, the animal substrate is or comprises an animal hide, which is preferably selected from animal hides obtained from cows, pigs, goats and sheep.

The method may comprise one or more subsequent steps selected from dyeing, drying, coating, lacquering, polishing, cutting, shaping, forming, embossing, punching, gluing, sewing, stapling and packaging the tanned animal substrate.

According to a second aspect of the invention there is provided an animal substrate obtained by the method according to the first aspect of the present invention.

According to a third aspect of the present invention there is provided an article which is or comprises an animal substrate according to the second aspect of the present invention wherein said article is selected from one or more of: articles of apparel and personal accessories, footwear, bags, briefcases and suitcases, covers for phones, tablets and laptops, saddlery, furniture and upholstered articles, sporting goods and accessories, pet collars and leashes, and vehicle interior coverings.

DETAILED DESCRIPTION

Figures

FIG. 1 is a depiction of a thermogram obtained from a differential scanning calorimeter. It shows how the shrinkage onset temperature is obtained.

ORDER OF METHOD STEPS

The steps in the method according to the present invention can be performed in any order. Step ii) may be followed by step i), although more typically step i) is followed by step ii).

The steps i) and ii) can be performed separately, simultaneously or the steps i) and ii) overlap in time. Preferably, steps i) and ii) are performed substantially separately. The separation of each step has been found to be particularly desirably so as to control the conditions of the tanning processes in each step. Such conditions include temperature, time and especially pH. Controlling the pH of steps i) and ii) has been found to be particularly desirable to provide better tanning results.

Solid Particulate Material

The solid particulate material has an average particle size of from 1 to 500 mm, more typically from 1 to 100 mm, even more typically from 1 to 50 mm, especially typically from 1 to 10 mm and most typically from 2 to 8 mm.

In other embodiments the solid particulate material has an average particle size of from 1.0 to 5.0 mm and in further embodiments of from 2.5 to 4.5 mm.

The average is a number average. The average is preferably performed on at least 10, more preferably at least 100 particles and especially at least 1000 particles.

The size of each particle is established by measuring the volume of particle and then assuming it is a sphere and calculating the effective diameter corresponding to a sphere having that volume; the effective diameter is then taken to be the particle size.

Preferably, the solid particulate material has a length of from 1 to 500 mm and in particular from 1 to 100 mm. Typically, the solid particulate material has a length of from 1 to 25 mm, or from 1 to 15 mm or from 1 to 10 mm, or from 1 to 6.0 mm, or from 1.0 to 5.0 mm or from 2.5 to 4.5 mm. The length can be defined as the maximum dimension of each three-dimensional solid particle. The average is preferably a number average. The average is preferably performed on at least 10, more preferably at least 100 particles and especially at least 1000 particles of the solid particulate material.

Preferably, the solid particulate material can comprise a multiplicity of polymeric particles, a multiplicity of non-polymeric particles or a mixture of a multiplicity of polymeric and non-polymeric particles.

The solid particulate material typically is or comprises a polymeric or non-polymeric material.

The polymeric or non-polymeric particles can comprise or be in the form of beads.

Preferably, a polymeric particle has an average volume of from 1 to 500 $mm^3$, more preferably from 5 to 275 $mm^3$.

Preferably, the polymer in the polymeric particles is or comprises polyalkenes, polyamides, polyesters, polysiloxanes, polyurethanes or copolymers thereof.

Thus, the polymer in the polymeric particles can be or comprise polyalkenes or polyurethanes, or copolymers thereof.

Thus, the polymer in the polymeric particles can be or comprise polyamide or polyester or copolymers thereof.

Preferably, said polyamide is or comprises Nylon.

Preferably, the polyamide is or comprises Nylon 6 or Nylon 6,6.

Preferably, the polyester is or comprises polyethylene terephthalate or polybutylene terephthalate.

The solid particulate material can be partially or substantially soluble. Typically, however the solid particulate material is substantially insoluble. Preferably, the fluid in which solubility or insolubility is determined is water, more preferably water at pH 7.0, and especially water at a temperature of 25° C. For the purposes of this invention the solid particulate material is determined to be insoluble if the solubility is less than 5 wt %, more typically less than 1 wt % in a given fluid (typically water).

The particles of the solid particulate material can be chemically modified to include one or more moieties selected from the group consisting of: enzymes, oxidizing agents, catalysts, metals, reducing agents, chemical cross-linking agents and biocides.

Preferably, the non-polymer in the non-polymeric particles is or comprises ceramic material, refractory material, igneous, sedimentary or metamorphic minerals, composites, metal or glass.

The solid particulate material may be in the shape of cylinders, ellipsoids, spheres, cuboids and shapes which are intermediates between these. Of these ellipsoids, spheres and the shapes in-between are preferred.

Typically, the particulate solid material has a density of from 0.5 to 20 g/cm$^3$, more typically from 1 to 10 g/cm$^3$, even more typically from 1 to 8 g/cm$^3$, yet more typically from 1 to 5 g/cm$^3$. Where the particulate solid material is or comprises a polymer the density is preferably from 1 to 3 g/cm$^3$, especially from 1.2 to 2.5 g/cm$^3$ and most especially from 1.3 to 2.0 g/cm$^3$. Such densities are considered to provide a particularly good balance of mechanical action and separation efficiency to aid separation of the particulate solid material from the substrate after the tanning steps.

The agitation steps i) or ii) may be performed in the presence of the particulate solid material, and preferably the agitation steps in both i) and ii) are performed in the presence of the particulate solid material.

At least some of the agitation in step i) and/or step ii) is performed in the presence of the particulate solid, more preferably at least some of the agitation in each of steps i) and ii) is performed in the presence of the particulate solid material, and more preferably at least some of the agitation in both of steps i) and ii) is performed in the presence of the particulate solid material.

Preferably, the particulate solid material is present in step i) and/or step ii) for at least 50, 60, 70, 80, 90 or 95% of the time taken for the step or steps.

Preferably the agitation in steps i) and/or ii) is performed entirely in the presence of the particulate solid material, and more preferably the agitation in steps i) and ii) is performed entirely in the presence of the particulate solid material.

Preferably, the particulate solid material is re-used in one or more subsequent tanning methods according to the first aspect of the present invention.

Chromium Free Tanning Agent

At least one chromium-free tanning agent must be present in step i). A plurality of chromium-free tanning agents can be present in step i). Preferably, no tanning agent present in step i) is a chromium-containing tanning agent, more preferably no tanning agent present in step i) and step ii) is a chromium-containing tanning agent, yet more preferably no tanning agent present in any part of the tanning process is a chromium-containing tanning agent.

Suitable chromium-free tanning agents include those selected from vegetable tanning agents, synthetic tanning agents and aldehydic tanning agents (especially aldehydes). Other suitable chromium-free tanning agents include mineral tanning agents including, for example, tanning agents containing aluminium, titanium, zirconium and iron. Of these vegetable tanning agents have been found to be especially suitable for providing tanned animal substrates having desirable hydrothermal stability.

The vegetable tanning agent preferably is or comprises a catechol. Preferably, the vegetable tanning agent is or comprises an extract selected from mimosa, birch, hemlock, quebracho, alder, fir and oak or a chemical derivative thereof. Of these mimosa extracts and chemical derivatives thereof have been found to be especially suitable for hydrothermal stability. Vegetable tanning agents are often extracts from leaves or more commonly bark.

The chromium-free tanning agent (especially the vegetable tanning agent) can be sulphited but is more preferably not sulphited.

The chromium-free tanning agent(s) is/are present in a total amount of from 0.1 to 100 wt %, more preferably from 1 to 100 wt %, even more preferably from 1 to 50 wt % and yet more preferably from 1 to 20 wt % relative to the weight of animal substrate. The weight refers to the wet weight of the animal substrate. The amounts refer to the active or dry amount of the tanning agent(s).

Conditions for Step i)

Preferably step i) is performed at a temperature of from 5 to 95° C., more preferably from 5 to 80° C. and especially from 5 to 60° C.

Step i) is typically performed for a period of from 10 minutes to 10 hours, more typically from 10 minutes to 5 hours and most typically from 30 minutes to 4 hours.

Step i) can be performed at a pH of from 1 to 10, more typically from 2 to 10, even more typically at a pH of from 2 to 8 and especially a pH of from 3 to 6.

Step i) can be performed at a pH of no more than 7, more typically no more than 6, even more typically no more than 5, yet more typically at a pH of no more than 4.5. The lower limit for the pH is typically pH 1, 2 or 3.

Oxazolidine Tanning Agent

It has been found that oxazolidine tanning agents are particularly effective when used in conjunction with chromium-free and more especially vegetable tanning agents.

The oxazolidine group in the oxazolidine tanning agent can be a 1,2-oxazolidine (also known as an isoxazolidine) but is preferably 1,3-oxazolidine.

Preferably, the tanning agent having an oxazolidine group has one or more oxazolidine groups of the chemical Formula (1) or (2):

Formula (1)

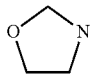

Formula (2)

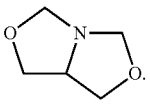

Especially suitable tanning agents having an oxazolidine group are those of the Formula (3), (4) and (5):

Formula (3)

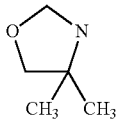

Formula (4)

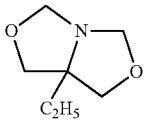

Formula (5)

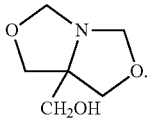

The tanning agent of Formula (3) is 4,4-Dimethyl-1-oxa-3-aza-cyclopentane and has a more trivial name Oxazolidine A.

The tanning agent of Formula (4) is 5-Ethyl-1-aza-3,7-dioxabyciclo [3,3,0] octane and has a more trivial name Oxazolidine E.

The tanning agent of Formula (5) is 5-Hydroxymethyl-1-aza-3,7-dioxabyciclo [3,3,0] octane and has a more trivial name Oxazolidine T.

Oxazolidine A, E and T have been found to be particularly effective oxazolidine tanning agents especially in conjunction with vegetable tanning agents.

Suitable oxazolidines can be obtained from Trumpler GmbH under the Trupotan tradename or from Angus chemicals Ltd under the Zolidine trade name.

The tanning agent containing an oxazolidine group used in step ii) of the present invention is preferably chromium-free. Preferably, no tanning agent present in step ii) is a chromium-containing tanning agent.

For clarification a tanning agent which is both chromium-free and which has an oxazolidine group is preferably regarded, for the purposes of this invention, as a tanning agent having an oxazolidine group. Accordingly, the chromium-free tanning agent in step i) preferably has no oxazolidine groups.

Typically, the tanning agent having an oxazolidine group is present in an amount of from 0.1 to 100%, more typically from 1 to 50 wt %, especially typically from 1 to 20 wt % by weight relative to the weight of animal substrate. The weight refers to the wet weight of the animal substrate. The amount of tanning agent is based on the active or dry amount.

Conditions for Step II)

Step ii) is typically preformed for a period of from 10 minutes to 10 hours, more typically from 30 minutes to 5 hours and most typically from 1 to 4 hours.

Step ii) is preferably performed at a temperature of from 5 to 95° C., more preferably from 10 to 80° C. and especially from 20 to 80° C. and most especially from 35 to 65° C.

Typically, step ii) is performed at a pH of at least 3, more typically at least 4, even more typically at least 5, yet more typically at a pH of at least 6. The upper limit for the pH may be 12, 11, 10, 9, 8 or more typically 7. Step ii) can be performed at a pH of from 3 to 10, more typically at a pH of from 5 to 10, especially at a pH of from 5 to 9 and most especially a pH of from 6 to 7.

Pre-Tanning—Step A)

The method according to the first aspect of the present invention can additionally comprises a tanning step A) of agitating the animal substrate with an aldehyde-containing tanning agent.

Preferably, the aldehyde-containing tanning agent in step A) is or comprises glutaraldehyde.

Preferably, the optional tanning step A) precedes tanning step i).

The amount of aldehyde-containing tanning agent present during step A) is typically from 0.1 to 100 wt %, more typically from 1 to 50 wt % and especially from 1 to 20 wt % based on the weight of animal substrate. The weight of animal substrate is calculated based on the wet weight.

Preferably, the agitation in step A) is performed at least partly, more preferably entirely in the presence of the particulate solid material.

Step A) is preferably conducted at a pH of from 1 to 5, more preferably from 2 to 4 and especially at a pH of around 2.5 to 3.5.

Agitation

The agitation in any of the steps i) or ii) or optional steps such as A) can be of any kind. Preferred kinds of agitation include shaking, stirring, ultrasonication and especially rotating. Rotation so as to cause the animal substrate to tumble is especially preferred.

The agitation need not be conducted for any entire tanning time. The agitation may be continuous or intermittent.

The agitation is preferably achieved by rotating an animal substrate in a drum. The drum may additionally contain a fluid. The drum preferably also contains the particulate solid material.

Animal Substrate

Preferably, the animal is or comprises an animal skin or more preferably a hide.

Preferably the animal hide is selected from animal hides obtained from cows, pigs, goats and sheep, of these cow hides are especially preferred.

Fluids and Water

Preferably, at least some of the agitation steps are performed for at least some of the time in the presence of a fluid, which preferably is or comprises a liquid, which preferably is or comprises water. When water is present it preferably has the pH values in steps i) and/or ii) as previously mentioned herein.

More preferably, both of the agitation steps i) and ii) are performed for at least some of the time in the presence of a liquid medium, which preferably is or comprises water. Similarly, it is preferred that step A) is performed for at least some of the time in the presence of a liquid medium, which preferably is or comprises water.

Fluids (e.g. water) may be added to the animal substrate or to the particulate solid. The fluids (e.g. water) are typically introduced with the chromium-free and/or oxazolidine group-containing tanning agents. Fluids (e.g. water) may be added prior to, during or after agitation steps i) or ii)

Removal of Particulate Solid

Preferably, after completion of the tanning method according to the first aspect of the present invention the particulate solid material is removed from the tanned animal substrate.

The removed particulate solid material can then be stored and is preferably re-used in subsequent tanning methods according to the first aspect of the present invention.

Ratios

Preferably, the weight ratio of animal substrate:particulate solid material is from 10:1 to 1:10, more preferably from 5:1 to 1:5, preferably from 3:1 to 1:3, preferably from 2:1 to 1:2.

Preferably, the weight of the animal substrate for this ratio is based on the wet weight of the animal substrate.

Preferably, the weight ratio of the animal substrate:fluid, as used herein, refers to the weight of the fluid added prior to, during or after step i) and step ii) and, when present, step A). The weight ratio of the animal substrate:fluid, as used herein preferably excludes any fluid associated with the optional moistening step described herein and/or preferably excludes any latent fluid (typically water) present within the animal substrate itself.

Preferably, throughout this invention the dry weight of a wet substrate is from 25 to 75 wt % of the wet weight, typically about 50 wt %. So for example, 2 kgs of wet animal substrate comprises 1 kg of dry animal substrate.

Preferably, the weight ratio of the animal substrate:fluid (especially water) is from about 1:5 to about 100:1, typically from about 1:2, typically from about 1:1, and typically from about 2:1, typically from about 3:1 and typically from about 5:1, typically no more than about 40:1, typically no more than about 30:1, typically no more than about 20:1, and typically no more than about 15:1. Preferably the weight of the animal substrate is based on the wet weight of the animal substrate.

Preferably, the weight ratio of the dry animal substrate: fluid is 10:1 to 1:10, more preferably 7:1 to 1:7, even more preferably 4:1 to 1:4, yet more preferably 3:1 to 1:3 and most preferably 2:1 to 1:2 by weight.

Preferably, the ratio of the volume of the drum (in $m^3$):to the weight of fluid in the drum (in metric tonnes) is from about 1:100 to about 100:1.

Preferably, the ratio of the volume of the drum (in $m^3$):to the weight of fluid in the drum (in metric tonnes) is in order of increasing preference at least 1:4, 1:3, 1:2, 1:1, 2:1, 3:1, 4:1, 5:1, 10:1, 20:1, 25:1, 30:1, 35:1, 40:1, 45:1, 50:1, 60:1 and 70:1.

In some cases the ratio of the volume of the drum (in $m^3$):to the weight of fluid in the drum (in metric tonnes) is in order of increasing preference no more than about 75:1, no more than 60:1, no more than 50:1, no more than 40:1, no more than 30:1, no more than 25:1, no more than 20:1 and no more than 15:1.

Thus, a preferred method for tanning an animal substrate according to the first aspect of the present invention comprises the steps of:

A) agitating the animal substrate with an aldehyde-containing tanning agent.

i) agitating the animal substrate with a chromium-free tanning agent; and ii) agitating the animal substrate with a tanning agent having an oxazolidine group;

wherein the steps are performed in the order of step A) followed by step i) followed by step ii), preferably wherein the animal substrate is a moistened animal substrate;

wherein at least some of the agitation is performed in the presence of a solid particulate material (and preferably wherein at least some of the agitation in each of steps A) and i) and ii) is performed in the presence of the particulate solid material, and preferably wherein all of the agitation in each of steps A) and i) and ii) is performed in the presence of the particulate solid material);

wherein the solid particulate material has an average particle size of from 1 to 500 mm;

wherein the chromium-free tanning agent is one or more tanning agents selected from vegetable tanning agents, synthetic tanning agents and aldehydes (and is preferably a vegetable tanning agent) and is present in a total amount of from 0.1 to 100 wt % relative to the weight of animal substrate;

wherein the tanning agent having an oxazolidine group is present in an amount of from 0.1 to 100% by weight relative to the weight of animal substrate;

wherein the weight ratio of animal substrate:solid particulate material is from 10:1 to 1:10 (preferably from 2:1 to 1:2);

wherein at least some of the agitation steps are performed for at least some of the time in the presence of water and wherein the weight ratio of animal substrate to water is from 1:5 to 100:1 (preferably from 1:1 to 15:1).

Optional Additional Method Steps

The method according to the first aspect of the present invention is preferably conducted on a moistened animal substrate. A moistened animal substrate preferably exhibits a weight ratio of fluid:animal substrate of from about 1:1000 to about 10:1, preferably from about 1:100 to about 10:1, preferably from about 1:10 to about 10:1, preferably from about 1:1 to about 10:1. Preferably the fluid is or comprises water. Where weight ratios are defined herein with reference to the "wet weight" of the animal substrate, said "wet weight" refers to the moistened animal substrate. Thus, the method of the first aspect of the invention is preferably preceding by the step of moistening the animal substrate with a fluid, preferably by moistening with water, and where said method comprises a pre-tanning step A) as described herein then the moistening step is preferably conducted prior to the pre-tanning step A).

The method according to the first aspect of the present invention may be preceded by any one or more of the following steps including: skinning, curing, soaking, liming, de-hairing and scudding, de-liming, bating and pickling, and where said method comprises the pre-tanning step A) as described herein then said preceding step(s) is/are preferably conducted prior to the pre-tanning step A). Said preceding step(s) may result in a moistened animal substrate for use in the method of the present invention.

The method according to the first aspect of the present invention can be followed by any one or more of the following steps including: dyeing, drying, coating, lacquering, polishing, cutting, shaping, forming, embossing, punching, gluing, sewing, stapling and packaging the tanned animal substrate.

Further Aspects of the Invention

According to a fourth aspect of the invention, there is provided the use of a solid particulate material in a method for tanning an animal substrate wherein said method comprises the steps of (i) agitating the animal substrate with a chromium-free tanning agent and (ii) agitating the animal substrate with a tanning agent having an oxazolidine group, wherein at least some of the agitation is performed in the presence of a solid particulate material, wherein the solid particulate material has an average particle size of from 1 to 500 mm, and wherein said use is for the purpose of improving one or more properties selected from the group consisting of:

(1) hydrothermal stability;
(2) photochemical and/or thermal resistance;
(3) the degree of incorporation of the tanning agent into said substrate; and
(4) the degree of penetration of the tanning agent into said substrate.

According to a fifth aspect of the invention, there is provided a tanning method for improving one or more properties of an animal substrate, wherein said properties are selected from the group consisting of:

(1) hydrothermal stability;
(2) photochemical and/or thermal resistance;
(3) the degree of incorporation of a tanning agent into said substrate; and
(4) the degree of penetration of a tanning agent into said substrate, wherein said method comprises the steps of (i) agitating the animal substrate with a chromium-free tanning agent and (ii) agitating the animal substrate with a tanning agent having an oxazolidine group, wherein at least some of the agitation is performed in the presence of a solid particulate material, and wherein the solid particulate material has an average particle size of from 1 to 500 mm.

In the fourth and fifth aspects of the invention, the improvement of said properties is relative to a tanning method in which said solid particulate material is not used.

In the fourth and fifth aspects, an improvement in hydrothermal stability is particularly preferred, optionally in combination with improvement in one or more of the other properties defined in the fourth and fifth aspects. Herein, hydrothermal stability is preferably determined as the shrinkage onset temperature of a moist sample measured by differential scanning calorimetry at 5° C./minute over a temperature range of 20 to 140° C. Preferably, the method of the present invention provides an animal substrate which exhibits a shrinkage onset temperature of at least 95° C., preferably at least 98° C. and preferably at least 100° C.

In all cases the shrinkage onset temperature is preferably measured by a calorimeter, especially a differential scanning calorimeter (DSC), which is preferably operated in accordance with BS EN ISO 11357-3:2013. The preferred temperature range is 20 to 140° C. The preferred scanning speed is 5° C./min. A preferred calorimeter is a: Mettler Toledo 822e DSC. The shrinkage onset temperature is preferably recorded as the point (a) where the baseline intersects with the tangent at the inflection point in the DSC curve as shown in FIG. 1 (i.e. the first inflection point in the DSC curve). Thermograms are preferably analysed using Star Software (v 1.13) recording onset/peak temperature and the integral is preferably normalised (suitably assuming a normal distribution around the peak temperature).

All features of the first aspect of the invention described hereinabove, and combinations of said features, are applicable to the fourth and fifth aspect of the inventions.

The animal substrate of the second aspect of the invention exhibits an improvement in one or more properties selected from the group consisting of:

(1) hydrothermal stability;
(2) photochemical and/or thermal resistance;
(3) the degree of incorporation of the tanning agent into said substrate; and
(4) the degree of penetration of the tanning agent into said substrate, relative to an animal substrate prepared by a tanning method in which said solid particulate material is not used. In particular, the animal substrate of the second aspect of the invention preferably exhibits a shrinkage onset temperature of at least 95° C., preferably at least 98° C. and preferably at least 100° C.

According to a sixth aspect of the invention, there is provided a tanned animal substrate which is chromium-free and which exhibits an improvement in one or more properties selected from the group consisting of:

(1) hydrothermal stability;
(2) photochemical and/or thermal resistance;
(3) the degree of incorporation of the tanning agent into said substrate; and
(4) the degree of penetration of the tanning agent into said substrate, relative to an animal substrate prepared by a tanning method in which a solid particulate material is not used. In particular, the animal substrate of the sixth aspect of the invention preferably exhibits a shrinkage onset temperature of at least 95° C., preferably at least 98° C. and preferably at least 100° C.

According to a seventh aspect of the invention, there is provided a tanned animal substrate which is chromium-free and which exhibits a shrinkage onset temperature of at least 95° C., preferably at least 98° C. and preferably at least 100° C.

As used herein, the term "chromium-free" when applied to a tanned animal substrate preferably means an extractable chromium content of less than 0.1 mg/kg, preferably less than 0.01 mg/kg, preferably less than 0.001 mg/kg, and preferably 0 mg/kg (expressed in mg of chromium per kg of animal substrate and preferably measured according to ISO-17072).

According to an eighth aspect of the present invention there is provided an article which is or comprises an animal substrate according to the sixth or seventh aspects of the present invention wherein said article is selected from one or more of: articles of apparel and personal accessories, footwear, bags, briefcases and suitcases, covers for phones, tablets and laptops, saddlery, furniture and upholstered articles, sporting goods and accessories, pet collars and leashes, and vehicle interior coverings.

DEFINITIONS

In the present invention any item mentioned in the singular is, unless the invention indicates to the contrary to be regarded as also encompassing the plural. Thus, by example, a chromium-free tanning agent includes one or more chromium-free tanning agents. Equally, a solid particulate material includes one or more particulate solid materials.

EXAMPLES

The invention will now be further illustrated, though without in any way limiting the scope thereof, by reference to the following examples.

Comparative Example 1

In step A) wet pickled bovine hides (Scottish Leather Group, UK) were tanned by tumbling the hides with 3 wt % based on hides of a poly-glutaraldehyde product (Selletan WL-G) (TFL GmbH) at pH 3.0-4.2, at a temperature of 35° C. over a period of 4 hours.

In step i) the hides resulting from step A) were partially dried to a moisture content of 35% using mechanical extraction and then shaved to thickness of 1.4 mm, the hides were then tanned by tumbling the hides with a vegetable tannin (10 wt % based on hides) Mimosa ME (Forestal Ltd. SA) at pH of 6.5 and a temperature of 35° C. for a period of 4 hours.

In step ii) the hides resulting from step i) were further tanned by tumbling with an oxazolidine tanning agent, namely Trupotan OXB (15 wt % based on the hides) (Trumpler GmbH, Worms, Germany) at a pH of 6.5, a temperature of from 40-60° C. for a period of 4 hours.

During the tumbling steps the wet animal substrate:water ratio was 10:15 by weight.

In each case the tumbling was performed in a Dose leather processing drum (Ring Maschinenbau GmbH (Dose), Lichtenau, Germany) (model 08-60284 with an internal volume of 85 L).

This prepared Comparative Leather (1).

Example 1

Solid particulate material in the form of Teknor Apex™ grade TA101M (Polyester—PET) beads supplied by Teknor Apex UK was used in this Example. The PET beads had a particle size of about 4 mm and a density of about 1.4 g/cm3 the shape of the particles was largely ellipsoidal. Example 1 was performed exactly as was Comparative Example 1 except that beads were present with a wet animal substrate: PET beads:water ratio of 10:14:1.0 on a weight basis. The beads were present in steps A), i) and ii).

This prepared Leather (1) by a method according to the first aspect of the present invention.

Leather Analysis

The shrinkage onset temperatures of leather prepared in the above examples were measured using a differential scanning calorimeter (DSC) (model: Mettler Toledo 822e DSC). A moist leather sample was scanned at 5° C./minute over the temperature range 20-140° C. with reference to an empty weighed, pierced aluminium pan. The calorimeter was otherwise operated generally in accordance with BS EN ISO 11357-3:2013. The shrinkage onset temperature is recorded as the point (a) where the baseline intersects with the tangent at the inflection point in the DSC curve as shown in FIG. 1 (i.e. the first inflection point in the DSC curve). Thermograms were analysed using Star Software (v 1.13) recording onset/peak temperature and the integral was normalised (suitably assuming a normal distribution around the peak temperature).

Results

TABLE 1

Showing the effect of the presence of the particulate solid material on shrinkage temperature.

| Process | Tanning agents | Particulate solid material | Shrinkage Onset Temperature (DSC) (° C.) |
|---|---|---|---|
| Leather (1) | Sellatan WL-G, Mimosa ME Trupotan OXB | PET - Beads | 100 |
| Comparative Leather (1) | Sellatan WL-G, Mimosa ME Trupotan OXB | None | 92 |

If the shrinkage onset temperature was equal to or greater than 100° C. (as measured by DSC) then the leather was deemed to have been especially well tanned. As per Table 1, it was shown that the presence of a particulate solid material resulted in significant improvements in shrinkage temperature compared with a method where the particulate solid material was not present. The improved hydrothermal stability as shown by the higher onset shrinkage temperature demonstrates that the tanning reactions progressed to a greater extent in the method of the present invention.

In addition the process for making Leather (1) involved the use of a significantly lower quantity of water as compared to the process used for making Comparative Leather (1).

The invention claimed is:

1. A method for tanning an animal substrate comprising the steps:

i) agitating the animal substrate with a chromium-free tanning agent; and ii) agitating the animal substrate with a tanning agent having an oxazolidine group;

wherein at least some of the agitation is performed in the presence of a solid particulate material, and wherein the solid particulate material has an average particle size of from 1 to 500 mm.

2. A method according to claim 1 wherein the steps i) and ii) are performed separately, simultaneously or where steps i) and ii) overlap in time.

3. A method according to claim 1 wherein steps i) and ii) are performed in the order step i) followed by step ii).

4. A method according to claim 1 wherein at least some of the agitation in both steps i) and ii) is performed in the presence of the particulate solid material.

5. A method according to claim 1 wherein the solid particulate material has an average particle size of from 1 to 50 mm.

6. A method according to claim 5 wherein the solid particulate material has an average particle size of from 1 to 10 mm.

7. A method according to claim 1 wherein the solid particulate material has a density of from 1.0 to 5.0 g/cm$^3$.

8. A method according to claim 1 wherein the chromium-free tanning agent is one or more tanning agents selected from vegetable tanning agents, synthetic tanning agents and aldehydes.

9. A method according to claim 8 wherein the chromium-free tanning agent is or comprises a vegetable tanning agent.

10. A method according to claim 9 wherein the vegetable tanning agent is or comprises a catechol.

11. A method according to claim 9 wherein the vegetable tanning agent is or comprises an extract selected from mimosa, birch, hemlock, quebracho, alder, fir and oak or a chemical derivative thereof.

12. A method according to claim 11 wherein the vegetable tanning agent is or comprises an extract from mimosa or a chemical derivative thereof.

13. A method according to claim 1 wherein the chromium-free tanning agent is not sulphited.

14. A method according to claim 1 wherein the chromium-free tanning agent(s) is/are present in a total amount of from 0.1 to 100 wt % relative to the weight of animal substrate.

15. A method according to claim 1 wherein the tanning agent having an oxazolidine group has one or more oxazolidine groups of the chemical Formula (1) or (2):

Formula (1)

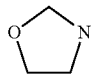

Formula (2)

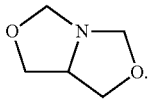

16. A method according to claim 1 wherein the tanning agent containing an oxazolidine group is of the Formula (3), (4) and (5):

Formula (3)

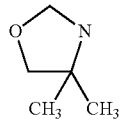

Formula (4)

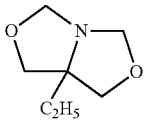

Formula (5)

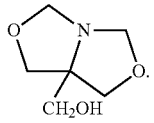

17. A method according to claim 1 wherein the tanning agent having an oxazolidine group is present in an amount of from 0.1 to 100% by weight relative to the weight of animal substrate.

18. A method according to claim 1 wherein step i) is performed at a pH of no more than 5.

19. A method according to claim 18 wherein step i) is performed at a pH of no more than 4.5.

20. A method according to claim 1 wherein step ii) is performed at a pH of at least 5.

21. A method according to claim 20 wherein step ii) is performed at a pH of at least 6.

22. A method according to claim 1 which additionally comprises a tanning step A) of agitating the animal substrate with an aldehyde-containing tanning agent.

23. A method according to claim 22 wherein the aldehyde-containing tanning agent in step A) is or comprises glutaraldehyde.

24. A method according to claim 22 wherein the tanning step A) precedes step i).

25. A method according to claim 1 wherein the solid particulate material is or comprises a polymeric or non-polymeric material.

26. A method according to claim 25 wherein the solid particulate material is a polymeric material selected from polyalkylenes, polyesters, polyamides and polyurethanes including mixtures and copolymers thereof.

27. A method according to claim 1 wherein the weight ratio of animal substrate:solid particulate material is from 5:1 to 1:5.

28. A method according to claim 1 wherein at least some of the agitation steps are performed for at least some of the time in the presence of water.

29. A method according to claim 28 wherein the weight ratio of animal substrate to water is from 1:5 to 100:1.

30. A method according to claim 1 wherein the animal substrate is a moistened animal substrate, preferably wherein said moistened animal substrate exhibits a weight ratio of water:animal substrate of from about 1:10 to about 10:1.

31. A method according to claim 1 wherein the animal substrate is or comprises an animal hide.

32. A method according to claim 31 wherein the animal hide is selected from animal hides obtained from cows, pigs, goats and sheep.

33. A method according to claim 1 comprising one or more subsequent steps selected from dyeing, drying, coating, lacquering, polishing, cutting, shaping, forming, embossing, punching, gluing, sewing, stapling and packaging the tanned animal substrate.

34. An animal substrate obtained by the method according to claim 1.

35. A tanning method for improving one or more properties of an animal substrate, wherein said properties are selected from the group consisting of:

(1) hydrothermal stability;
(2) photochemical and/or thermal resistance;
(3) the degree of incorporation of a tanning agent into said substrate; and
(4) the degree of penetration of a tanning agent into said substrate, wherein said method comprises the steps of (i) agitating the animal substrate with a chromium-free tanning agent and (ii) agitating the animal substrate with a tanning agent having an oxazolidine group, wherein at least some of the agitation is performed in the presence of a solid particulate material, and wherein the solid particulate material has an average particle size of from 1 to 500 mm.

36. A tanned animal substrate which is prepared by a tanning method in which a solid particulate material and a tanning agent having an oxazolidine group is used, wherein the tanned animal substrate is chromium-free and exhibits an improvement in one or more properties selected from the group consisting of:

(1) hydrothermal stability;
(2) photochemical and/or thermal resistance;
(3) the degree of incorporation of the tanning agent into said substrate; and
(4) the degree of penetration of the tanning agent into said substrate, relative to an animal substrate prepared by a tanning method in which a solid particulate material is not used.

37. An article which is or comprises an animal substrate according to claim 34 wherein said article is selected from one or more of: articles of apparel and personal accessories, footwear, bags, briefcases and suitcases, covers for phones, tablets and laptops, saddlery, furniture and upholstered articles, sporting goods and accessories, pet collars and leashes, and vehicle interior coverings.

* * * * *